US006004179A

United States Patent [19]

Alwan

[11] Patent Number: 6,004,179

[45] Date of Patent: Dec. 21, 1999

[54] METHODS OF FABRICATING FLAT PANEL EVACUATED DISPLAYS

[75] Inventor: James J. Alwan, Boise, Id.

[73] Assignee: Micron Technology, Inc., Boise, Id.

[21] Appl. No.: 09/179,537

[22] Filed: Oct. 26, 1998

[51] Int. Cl.[6] ..... H01J 9/24

[52] U.S. Cl. ..... 445/24

[58] Field of Search ..... 445/24, 50, 25

[56] References Cited

U.S. PATENT DOCUMENTS

| | | | |
|---|---|---|---|
| 3,397,278 | 8/1968 | Pomerantz . | |
| 3,589,965 | 6/1971 | Wallis et al. . | |
| 5,486,126 | 1/1996 | Cathey et al. . | |
| 5,717,287 | 2/1998 | Amrine et al. . | |
| 5,733,160 | 3/1998 | Jeng et al. | 445/24 |
| 5,795,206 | 8/1998 | Cathey et al. . | |

OTHER PUBLICATIONS

Esashi, M. et al,; "Anodic Bonding For Integrated Capacitive Sensors"; Undated; pp. 43–48.

Albaugh, Kevin B,; "Electrode Phenomena during Anodic Bonding of Silicon to Sodium Borosilicate Glass"; J. Electrochem. Soc. vol. 38, No. 10; Oct. 1991; pp. 3089–3094.

Mun, J. D. et al,; "large Area Electrostatic Bonding for Macropackaging of a Field Emission Display"; undated; 4 pages.

U.S. applicationl No. 08/856,382 Hoffman et al. May 14, 1997.

*Primary Examiner*—Kenneth J. Ramsey

*Attorney, Agent, or Firm*—Wells, St. John, Roberts, Gregory & Matkin, P.S.

[57] ABSTRACT

In one aspect, the invention includes a method of fabricating a flat panel evacuated display. An oxidizable material layer is formed over a substrate upper surface. The oxidizable material has an upper surface and is provided as a plurality of separate discrete elements. A layer of sacrificial material is formed over the oxidizable material upper surface and over intervening regions of the substrate between the separate discrete elements. The sacrificial material is selectively removable relative to the oxidizable material. The layer of sacrificial material is planarized to remove the sacrificial material from over the oxidizable material upper surface. A plurality of spacers are bonded to the oxidizable material upper surface. The sacrificial material is removed from between the separate discrete elements.

50 Claims, 12 Drawing Sheets

METHODS OF FABRICATING FLAT PANEL EVACUATED DISPLAYS

PATENT RIGHTS STATEMENT

This invention was made with Government support under Contract No. DABT63-97-C-0001 awarded by Advanced Research Projects Agency (ARPA). The Government has certain rights in this invention.

TECHNICAL FIELD

The invention pertains to flat panel evacuated displays, such as those of the field emission cathode and plasma types. More particularly, the invention pertains to methods of incorporating load-bearing spacers into such displays.

BACKGROUND OF THE INVENTION

For more than half a century the cathode ray tube (CRT) has been the principal device for electronically displaying visual information. Although CRTs have been endowed during that period with remarkable display characteristics in the areas of color, brightness, contrast and resolution, they have remained relatively bulky and power hungry. The advent of portable computers has created intense demand for displays which are lightweight, compact, and power efficient. Liquid crystal displays (LCDs) are now used almost universally for lap-top computers. However, contrast is poor in comparison to CRTs, only a limited range of viewing angles is possible, and battery life is still measured in hours rather than days.

As a result of the drawbacks of LCD and CRT technology, field emission display (FED) technology has been receiving increased attention by industry. Flat panel displays utilizing FED technology employ a matrix-addressable array of cold, pointed field emission cathodes in combination with a luminescent phosphor screen. Somewhat analogous to a cathode ray tube, individual field emission structures are sometimes referred to as vacuum microelectronic triodes. Each triode has the following elements: a cathode (emitter tip), a grid (also referred to as the gate), and an anode (typically, the phosphor-coated element to which emitted electrons are directed).

The phenomenon of field emission was discovered in the 1950's, but it has been only within the last ten years that extensive research and development has been directed toward commercializing the technology. Low-power, high-resolution, high-contrast, monochrome flat panel displays with a diagonal measurement of about 15 centimeters have been manufacturing using field emission cathode array technology. Although useful for such applications as viewfinder displays in video cameras, their small size makes them unsuited for use as computer display screens.

In order for proper display operation, which requires emission of electrons from the cathodes and acceleration of those electrons to a phosphor-coated screen en, an operational voltage differential between the cathode array and the screen of at least 1,000 volts is required. The life of the phosphor coating on the screen increases as the voltage differential increases. Specifically, phosphor coatings on screens degrade as they are bombarded by electrons, with the rate of degradation being proportional to the rate of impact and the total accumulated dose of electrons incident (coulombic aging). As fewer electron impacts are required to achieve a given intensity level at higher voltage differentials, phosphor life can be extended by increasing the operational voltage differential. In order to prevent shorting between the cathode array and the screen, as well as to achieve distortion-free image resolution and uniform brightness over the entire expanse of the screen, highly uniform spacing between the cathode array and the screen is to be maintained.

During tests performed at Micron Display Technology, Inc. in Boise, Id., (presently a division of Micron Technology, Inc.) it was determined that, for a particular evacuated flat-panel field emission display utilizing glass spacer columns to maintain a separation of 250 microns (about 0.010 inches), electrical breakdown occurred within a range of 1,100 to 1,400 volts. All other parameters remaining constant, breakdown voltage will rise as the separation between screen and cathode array is increased. However, maintaining uniform separation between the screen and the cathode array is complicated by the need to evacuate the cavity between the screen and the cathode array to a pressure of less than $10^{-6}$ Torr to enable field emission.

Small area displays (for example, those which have a diagonal measurement of less than 3 centimeters) can be cantilevered from edge to edge, relying on the strength of a glass screen having a thickness of about 1.25 millimeters to maintain separation between the screen and the cathode array. Since the displays are small, there is no significant screen deflection in spite of the atmospheric load. However, as display size is increased the thickness of a cantilevered flat glass screen must be increased exponentially. For example, a large rectangular television screen measuring 45.72 centimeters (18 inches) by 60.96 centimeters (24 inches) and having a diagonal measurement of 76.2 centimeters (30 inches), must support an atmospheric load of at least 28,149 Newtons (6,350 pounds) without significant deflection. A glass screen (or face plate as it is also called) having a thickness of at least 7.5 centimeters (about 3 inches) might well be required for such an application. But that is only half of the problem. The cathode array structure must also withstand a like force without deflection. Although it is conceivable that a lighter screen could be manufactured so that it would have a slight curvature when not under stress, and be completely flat when subjected to a pressure differential, the fact that atmospheric pressure varies with altitude and as atmospheric conditions change makes such a solution impractical.

A more satisfactory solution to cantilevered screens and cantilevered cathode array structures is the use of closely spaced, load-bearing, dielectric (or very slightly conductive, i.e., greater than 10 mega-ohm) spacer structures. Each of the load-bearing structures bears against both the screen and the cathode array plate and thus maintains the two plates at a uniform distance between one another. By using load-bearing spacers, large area evacuated displays might be manufactured with little or no increase in the thickness of the cathode array plate and the screen plate.

Load-bearing spacer structures for field emission array displays generally conform to certain parameters. For instance, the spacer structures should be uniformly non-conductive to prevent catastrophic electrical breakdown between the cathode array and the anode (i.e., the screen). Also, in addition to having sufficient mechanical strength to prevent the flat panel display from imploding under atmospheric pressure, the spacers should exhibit a high degree of dimensional stability under pressure. Furthermore, the spacers should exhibit stability under electron bombardment, as electrons will be generated at each pixel location within the array. In addition, the spacers should be capable of withstanding "bake out" temperatures of about 400° C. that are likely to be used to create the high vacuum between the screen and the cathode array backplate of the display. Further, the material from which the spacers are made should not comprise volatile components which will sublimate or otherwise outgas under low pressure conditions.

For optimum screen resolution, the spacer structures should be nearly perfectly aligned to array topography, and should be of sufficiently small cross-sectional areas so as not to be visible. Cylindrical spacers must typically have diameters no greater than about 50 microns (about 0.002 inch) if they are not to be readily visible. For a single cylindrical lead oxide silicate glass column having a diameter of 25 microns (0.001 inch) and a height of 200 microns (0.008 inch), a buckle load of about $2.67\times10^{-2}$ Newtons (0.006 pound) has been measured. Buckle loads will of course decrease as height is increased with no corresponding increase in diameter. It is also noted that a cylindrical spacer having a diameter of d will have a buckle load that is only about 18% greater than that of a spacer of square cross-section and a diagonal d, even though the cylindrical spacer has a cross-sectional area about 57% greater than the spacer of square cross-section. If lead oxide silicate glass column spacers having a diameter of 25 microns and a height of 200 microns are to be used in the 76.2 centimeter diagonal display described above, slightly more than one million spacers will be required to support the atmospheric load. To provide an adequate safety margin that will tolerate foreseeable shock loads, that number should probably be doubled in commercially-produced flat panel evacuated displays.

There are a number of drawbacks associated with certain types of spacer structures which have been proposed for use in field emission cathode array-type displays. Spacer structures formed by screen or stencil printing techniques, as well as those formed from glass balls lack a sufficiently high aspect ratio. In other words, spacer structures formed by these techniques must be either so thick that they interfere with the display resolution, or so short that they provide inadequate panel separation for the applied voltage differential. Also, it is generally impractical to form spacer structures by masking and etching deposited dielectric layers in a reactive-ion or plasma environment, as etch steps on the order of 0.250 to 0.625 millimeters would not only greatly hamper manufacturing throughput, but would result in tapered structures (the result of mask degradation during the etch). Likewise, spacer structures formed from lithographically defined photoactive organic compounds are generally unsuitable for application in evacuated flat panel displays as such spacers tend to deform under pressure and to volatilize under both high-temperature and low-pressure conditions. The presence of volatilized substances within the evacuated portion of the display will shorten the life and degrade the performance of the display. Additionally, techniques which adhere stick-shaped spacers to a matrix of adhesive dots deposited at appropriate locations on the cathode array backplate are typically unable to achieve sufficiently accurate alignment to prevent display resolution degradation. Further, any misaligned stick which is adhered to only the periphery of an adhesive dot may later become detached from the dot and fall on top of a group of nearby cathode emitters, thus blocking their emitted electrons. In addition, if an organic epoxy adhesive is utilized for the dots, the epoxy may volatilize over time, leading to the problems heretofore described.

The present invention employs elements of processes disclosed in U.S. Pat. No. 5,486,126 ("the '126 patent", hereby incorporated by reference), as well as elements of processes disclosed in U.S. patent application Ser. No. 08/856,382 (hereby incorporated by reference). The '126 patent teaches the fabrication of an evacuated flat-panel display from specially formed spacer slices. Each spacer slice may be characterized as a matrix which includes permanent, bondable glass fiber strands embedded in a filler material that is selectively etchable with respect to the permanent glass fiber strands. The spacer slices are fabricated by forming a fiber strand bundle having an ordered arrangement of permanent glass fiber strands and filler material strands. The bundle, or a closely packed array of multiple bundles, is sawed into laminar slices and polished to have a final thickness corresponding to a desired spacer height. Multiple spacer slices are positioned on either a display base plate or a display face plate (for a field emission display the face plate is a transparent laminar plate that will be coated with phosphor dots or rectangles; the base plate incorporates the field emitters, as well as the circuitry required to activate the field emitters), to which adhesive (lots have been applied at desired spacer locations thereon. Once the adhesive dots have set up, the filler material within the spacer slices is etched away. Any unbonded permanent spacer columns are also washed away in the etch process. An array of permanent spacer columns remains on the base plate or face plate. The other opposing display plate is then positioned on top of the display plate to which the spacers have been affixed, the cavity between the face plate and the base plate is evacuated, and the edges of the face plate and base plate are sealed so as to hermetically seal the cavity.

Application Ser. No. 08/856,382, like the above-described '126 patent, teaches the fabrication of an evacuated flat-panel display from specially formed spacer slices. However, application Ser. No. 08/856,382, unlike the '126 patent, teaches that spacers are bound to a face plate assembly through anodic bonding processes, and teaches fabrication of spacer slices wherein glass material is utilized for both the spacers and the filler material. The glass filler materials are selectively etchable relative to the glass bonding strands. Such selective etchability can be achieved by having a higher percentage of PbO in the filler glass materials than in the bonding strands. For instance, the bonding strands can have a chemical composition of from about 35% to about 45% PbO, from about 28% to about 35% $SiO_2$, and a balance of $K_2O$, $Li_2O$ and RbO. In contrast, the filler strands typically have a percentage of PbO that is greater than 50%.

It is preferred that the fiber bonding strands and the filler strands have similar coefficients of expansion, and that the filler strands be selectively etchable relative to the fiber bonding strands. The increased concentration of lead oxide in the filler strands is but one method of accomplishing the above-discussed goals, and other combinations of glass formulations are known that will provide similar coefficients of expansion between glass filler materials and fiber bonding materials, while also enabling selective etchability of the filler materials relative to the bonding materials.

A method of forming a bundle of bonding fibers and filler fibers is to pack the bonding fibers and filler fibers together such that the bonding fibers are surrounded by filler fiber material. An exemplary ratio of bonding fiber strands to filler fiber strands is about 1:3.

Once the fibers are packed together, the bundle can be heated to a sintering temperature (i.e., a temperature at which all constituent fibers fuse together along contact lines or contact surfaces), and then drawn at elevated temperature to uniformly reduce a diameter of all fibers while maintaining a constant relative spacing arrangement between the fibers.

After the bundle is drawn, it can be cut into short intermediate links and redrawn. Ultimately, the drawn bundle has bonding glass fibers within the bundle with a proper diameter (or in other embodiments, rectangular cross-section) for an intended display, with a spacing between the permanent glass fibers corresponding to a spacing between anodic bonding sites of the intended display. The rods can then be packed to form a rectangular block, which is subsequently heated to a sintering temperature in order to fuse the bonding rods and filler rods into a rigid block.

After cooling, the rigid block is sawed into laminar slices. For a 1,500 volt flat-panel field emission display, spacers approximately 380 microns in length (about 0.15 inch) are generally required to safely prevent shorting between the face plate and the base plate. Thus, slices somewhat greater than 400 microns in thickness are cut from the rigid block, and each slice polished smooth on both major surfaces until a final thickness of the block is about 380 microns.

U.S. patent application Ser. No. 08/856,382 further discloses subjecting a laminar silicate glass substrate (soda lime silicate glass can be a preferred material) to a thermal cycle in order to dimensionally stabilize it prior to utilization as a face plate of a field emission display. A disclosed thermal stabilization process encompasses heating the substrate from 20° C. (room temperature) to 540° C. over a period of about three hours. The substrate is maintained at 540° C. for about 0.5 hours. Subsequently, over a period of about one hour, the substrate is cooled to 500° C., and then down to 20° C. over a period of about three hours. A preferred glass substrate has a strain temperature of about 528° C., an anneal temperature of about 548° C., and a transformation temperature (i.e., a temperature above which all silicon tetrahedra that make up the glass have freedom of rotational movement) of about 551° C.

After the silicate glass substrate is subjected to the thermal cycle, it is subjected to further processing to provide anodic bonding sites across a surface of the material, and to anodically bond the glass fiber bonding strands to the anodic bonding sites. Subsequently, the glass filler materials are etched away utilizing, for example, an acid bath having a temperature of from 20° C. to 40° C., and comprising from about 2% to about 10% hydrogen chloride in deionized water. The duration of the wet etch can vary from about 0.5 hours to about four hours, with the duration depending, at least in part, on an amount of agitation and a thickness of filler glass that is to be etched away. After removal of the filler material, any bonding strands that have not adhered to a desired bonding site on the silicate glass substrate are removed. The remaining silicate glass face plate with bonding strands provided only at desired bonding sites is then incorporated into a field effect display device. The bonding strands function as spacer structures within the device.

It would be desirable to develop alternative methods of incorporating load-bearing structures into field emission cathode array-type displays. The spacer structures should preferably be aligned in desired locations between a face plate and back plate.

SUMMARY OF THE INVENTION

In one aspect, the invention includes a method of fabricating a flat panel evacuated display. An oxidizable material layer is formed over a substrate upper surface. The oxidizable material has an upper surface and is provided as a plurality of separate discrete elements. A layer of sacrificial material is formed over the oxidizable material upper surface and over intervening regions of the substrate between the separate discrete elements. The sacrificial material is selectively removable relative to the oxidizable material. The layer of sacrificial material is planarized to remove the sacrificial material from over the oxidizable material upper surface. A plurality of spacers are bonded to the oxidizable material upper surface. The sacrificial material is removed from between the separate discrete elements.

In another aspect, the invention includes another method of fabricating a flat panel evacuated display. A transparent conductive layer is formed over an upper surface of a substrate. An oxidizable material is formed over the transparent conductive layer. The oxidizable material is provided in a plurality of separate discrete elements, with each element having a lower region and an upper region. The lower regions comprise lateral peripheries, and the upper regions do not extend to the lower region lateral peripheries. A layer of sacrificial material is formed over the oxidizable material and over intervening regions of the substrate between the separate discrete elements. The sacrificial material is selectively removable relative to the oxidizable material. The layer of sacrificial material is planarized to remove the sacrificial material from over the upper regions of the oxidizable material. A plurality of spacers is provided, with each spacer having a bondable surface. At least some of the bondable surfaces are positioned on upper surfaces of the oxidizable material. The bondable surfaces are anodically bonded to the oxidizable material. The sacrificial material is removed from between the separate discrete elements.

BRIEF DESCRIPTION OF THE DRAWINGS

Preferred embodiments of the invention are described below with reference to the following accompanying drawings.

FIG. 1 is a top plan view of a preferred embodiment "black" matrix pattern for a display using Sony Trinitron® scanning.

FIG. 3 corresponds to a view along the line C—C of FIG. 2, and corresponds to a preliminary processing step for formation of the structure described above with reference to FIG. 2.

FIG. 7 is a view of the FIG. 3 substrate at a processing step subsequent to that of FIG. 6.

FIG. 9 is a view of the FIG. 3 substrate at a processing step subsequent to that of FIG. 8.

FIG. 10 is a view of the FIG. 3 substrate at a processing step subsequent to that of FIG. 9.

FIG. 12 is a view of the FIG. 3 substrate at a processing step subsequent to that of FIG. 11 and incorporated into an FED device.

FIG. 13 is a fragmentary, diagrammatic, cross-sectional view of a substrate processed according to a second embodiment method of the present invention. The substrate of FIG. 14 is shown along the line C—C of FIG. 2, and corresponds to a preliminary processing step for formation of the structure described above with reference to FIG. 2.

FIG. 14 is a view of the FIG. 13 substrate at a processing step subsequent to that of FIG. 13.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

In one aspect, the invention pertains to methods of fabricating flat panel evacuated displays, and particularly pertains to methods of forming spacers between a face plate and a back plate. Typically, the spacers are first provided on a face plate to form a face plate/spacer assembly. Such assembly is then coupled with a back plate to fabricate a flat panel evacuated display.

Figure 2:
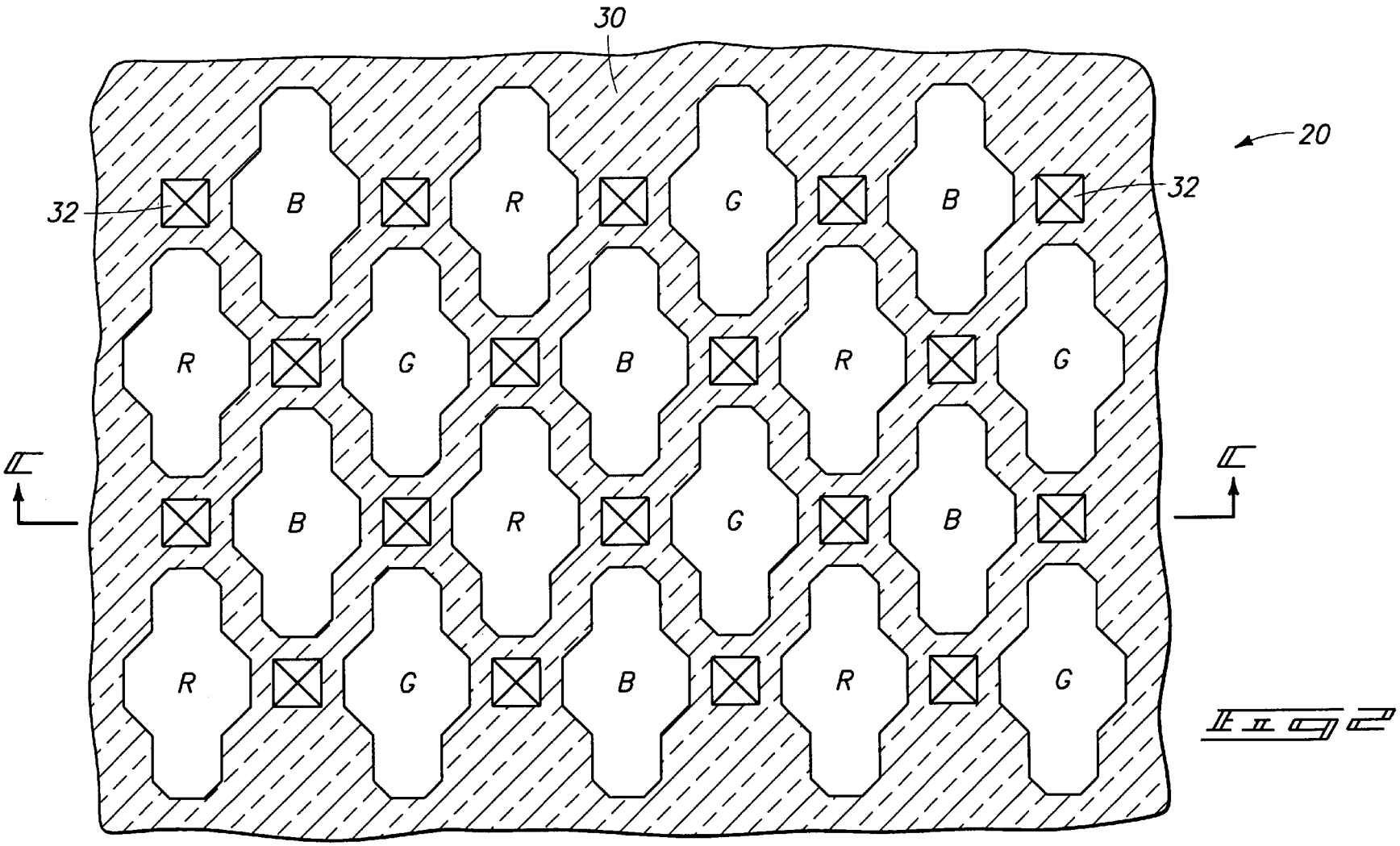
FIG. 2 is a top plan view of a preferred embodiment "black" matrix pattern for a conventionally-scanned color display.

Exemplary face plates 10 and 20 are illustrated in FIGS. 1 and 2, respectively. The face plates have red, green and blue phosphor regions (illustrated as regions labeled "R", "G", and "B", respectively) and black matrix areas 30 surrounding the phosphor regions. Also, face plates 10 and 20 comprise spacer bonding locations 32 (only some of which are labeled) defined within the black matrix regions. Face plate constructions 10 and 20 of FIGS. 1 and 2 are merely exemplary common face plate constructions, with construction 10 corresponding to a display using Sony Trinitron® scanning, and construction 20 corresponding to phosphor/black matrix pattern of a conventionally-scanned color display.

A first embodiment method of forming a face plate construction is described with reference to FIGS. 3–11. The first embodiment method is described specifically for formation of a face plate construction corresponding to construction 20 of FIG. 2. However, it is to be understood that the invention can be readily generalized by persons of ordinary skill in the art for utilization in forming other face plate constructions, such as, for example, the face plate construction 10 of FIG. 1.

Figure 3:
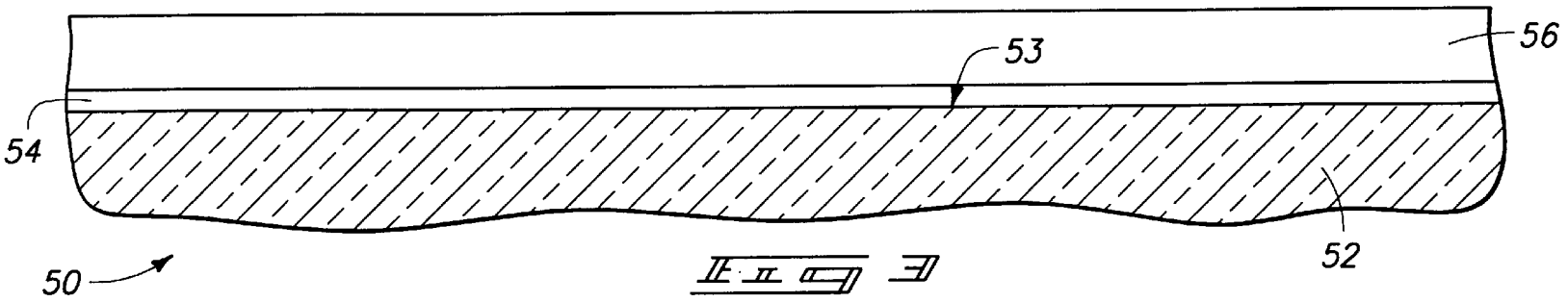
FIG. 3 is a fragmentary, diagrammatic, cross-sectional view of a substrate processed according to a first embodiment method of the present invention.

Referring to FIG. 3, a face plate fragment 50 is illustrated at a preliminary process step. Face plate fragment 50 is shown in a cross-sectional side view corresponding to a view along the line C—C of FIG. 2. It is noted that the scale of FIGS. 3–11 is different than that of FIG. 2 for clarity of illustration. In the preliminary step of FIG. 3, there is no phosphor yet provided, nor are the spacer locations (32 of FIG. 2) yet defined. Wafer fragment 50 comprises a glass substrate 52 having an upper surface 53. Substrate 52 can comprise, for example, a soda lime silicate glass which has been subjected to a thermal cycle to dimensionally stabilize it. An exemplary thermal cycle is described above in the "Background" section of this disclosure. A transparent, solid conductive material 54 is formed over substrate 52. Conductive material 54 can comprise, for example, indium tin oxide or tin oxide. Material 54 can be formed to a thickness of, for example, from about 2000 Å to about 2,500 Å, by, for example, chemical vapor deposition (CVD).

An oxidizable material layer 56 is formed over conductive material layer 54. An exemplary material is silicon. The silicon can be in the form of amorphous silicon or polycrystalline silicon, and can be conductively doped with a conductivity-enhancing dopant. A silicon-comprising layer 56 can be provided by, for example, CVD. Layer 56 is preferably provided to a thickness of from about 1 micron to about 3 microns.

Figure 4:
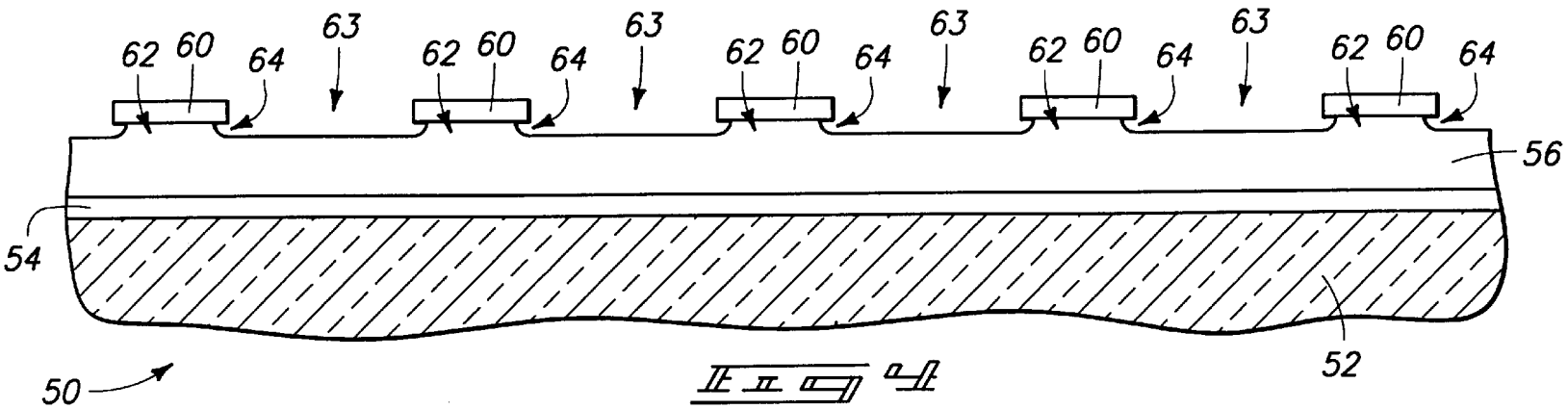
FIG. 4 is a view of the FIG. 3 substrate at a processing step subsequent to that of FIG. 3.

Referring to FIG. 4, a mask 60 is provided over oxidizable material 56 to cover portions 62 of material 56 and leave other portions 63 of material 56 uncovered. Mask 60 can comprise, for example, photolithographically processed photoresist.

After provision of masking layer 60, oxidizable material 56 is etched to form mesas 64 at the masked locations. It is noted that the etching extends only partially into unmasked regions 63, rather than extending entirely to underlying layer 54. An exemplary process for etching a silicon-comprising oxidizable material layer 56 is a plasma etch utilizing $CF_4$, $CHF_3$ and He in a ratio of 2:8:3 in a capacitively coupled plasma reactor operating at 350 mTorr and 1000 watts.

Figure 5:
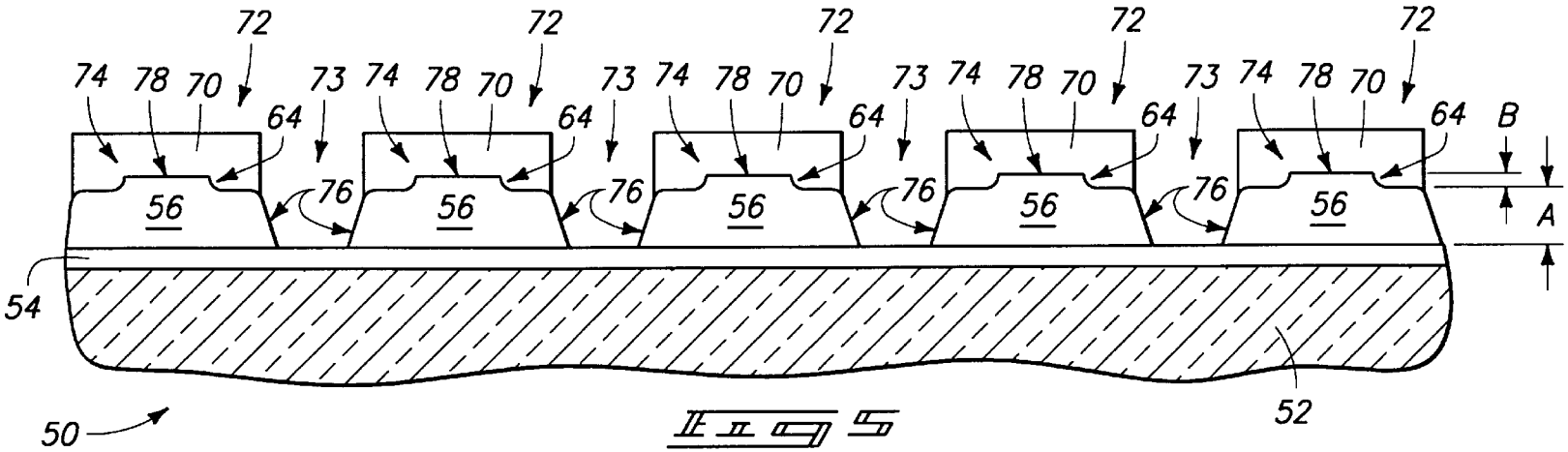
FIG. 5 is a view of the FIG. 3 substrate at a processing step subsequent to that of FIG. 4.

Referring to FIG. 5, a second masking layer 70 is provided over oxidizable material 56. Second masking layer 70 could comprise, for example, photolithographically processed photoresist. In the exemplary shown embodiment, second masking layer 70 is provided after removal of first masking layer 60. However, the invention encompasses other embodiments (not shown) wherein first masking layer 60 remains over oxidizable material layer 56 during provision of second masking layer 70. Second masking layer 70 defines masked locations 72 and unmasked locations 73 between masked locations 72. Masked locations 72 comprise mesas 64 and portions of oxidizable material 56 proximate mesas 64.

After provision of second masking layer 70, oxidizable material 56 is exposed to etching conditions to remove oxidizable material 56 from unmasked regions 73. Conductive layer 54 can function as an etch stop during such removal. Exemplary conditions for removing a silicon-comprising oxidizable material layer 56 include a plasma etch utilizing $CF_4$, $CHF_3$ and He in a ratio of 2:8:3 in a capacitively coupled plasma reactor operating at 350 mTorr and 1000 watts.

Removal of oxidizable material 56 from unmasked regions 73 separates the remaining oxidizable material 56 into separate discrete elements 74. Each of the separate discrete elements 74 comprises an upper region defined by mesas 64 and a lower region defined by remaining portions of oxidizable material 56 proximate mesas 64. The lower regions comprise lateral peripheries 76, and the upper regions do not extend to such lower region lateral peripheries. The lower regions have a thickness "A", and the upper regions have a thickness "B". Exemplary dimensions for "A" are from about 1 micron to about 2 microns, and exemplary dimensions for "B" are from about 2,000 Å to about 3,000 Å. The discrete elements 74 comprise uppermost surfaces 73, which are at the top of mesas 64. Uppermost surfaces 78 are provided at the spacer bonding locations 32 of FIG. 2.

Figure 6:
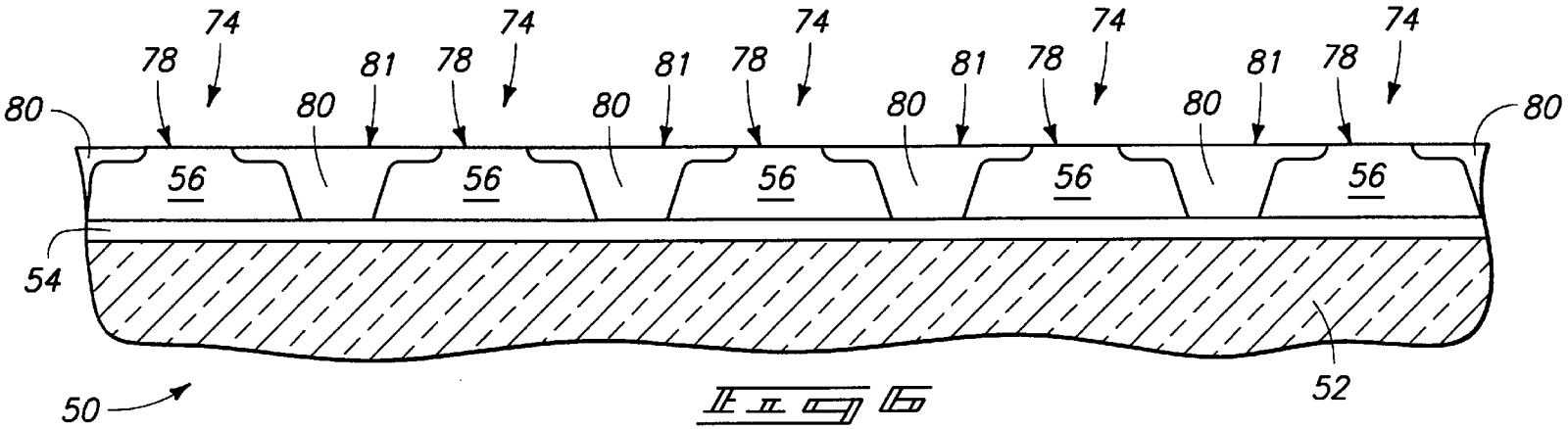
FIG. 6 is a view of the FIG. 3 substrate at a processing step subsequent to that of FIG. 5.
Figure 11:
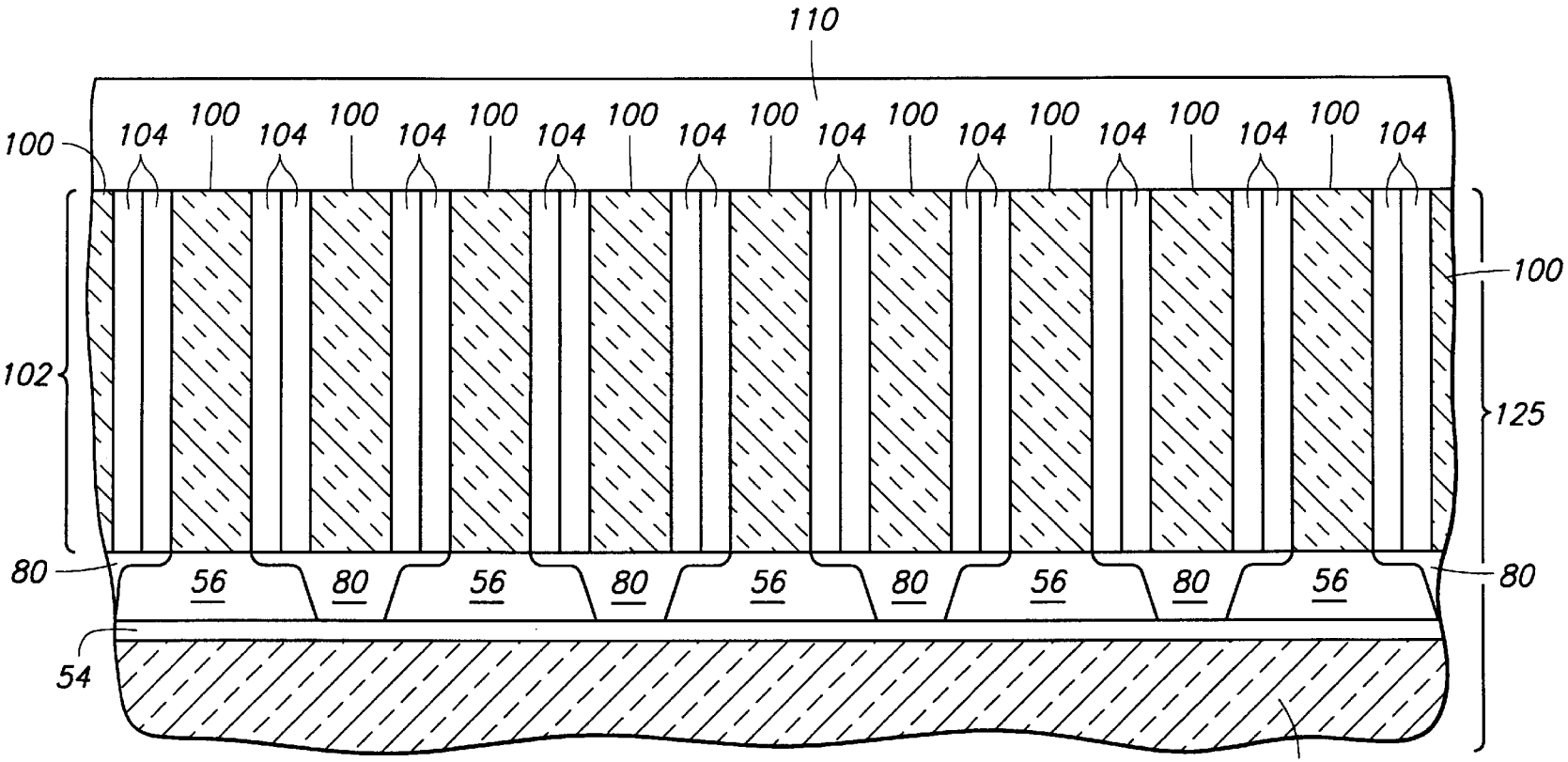

Referring to FIG. 6, masking layer 70 (FIG. 5) is removed. In embodiments in which masking layer 70 comprises photoresist, such can be removed by, for example, $H_2SO_4$ and $H_2O_2$ in a mixture comprising 50 ml $H_2O_2$ per gallon of $H_2SO_4$ at 70° C. After removal of masking layer 74, a sacrificial layer 80 is provided over discrete elements 74, and over upper surfaces 78. Sacrificial layer 80 is then planarized to remove the sacrificial material of layer 80 from over upper surfaces 78. The planarization planarizes upper surfaces 78 and forms planarized upper surfaces 81 of sacrificial material 80. The planarization can comprise, for example, chemical-mechanical polishing. Sacrificial material 80 comprises a material that is selectively removable relative to oxidizable material 56. In exemplary embodiments in which oxidizable material 56 comprises silicon, sacrificial material 80 can comprise, for example, at least one of cobalt oxide, aluminum, chromium, cobalt or molybdenum.

Referring to FIG. 7, a plurality of spacers 100 are provided over substrate 52. The spacers are provided as a polished, uniformly-thick spacer slice 102. Spacers 100 within the slice are separated by filler material 104. Spacers 100 and filler material 104 can both comprise glass, and can comprise exemplary constructions such as those discussed above in the "Background" section of this disclosure. It is noted that some of the spacers 100 contact upper surfaces 78 of the oxidizable material discrete elements 74, while other spacers 100 contact sacrificial material 80. The spacer slice 102 and face plate assembly 50 together comprise a face plate/spacer slice assembly 125. A metal foil electrode 110 (an exemplary material of electrode 110 is aluminum) is provided on an upper surface of slice 102.

Figure 8:
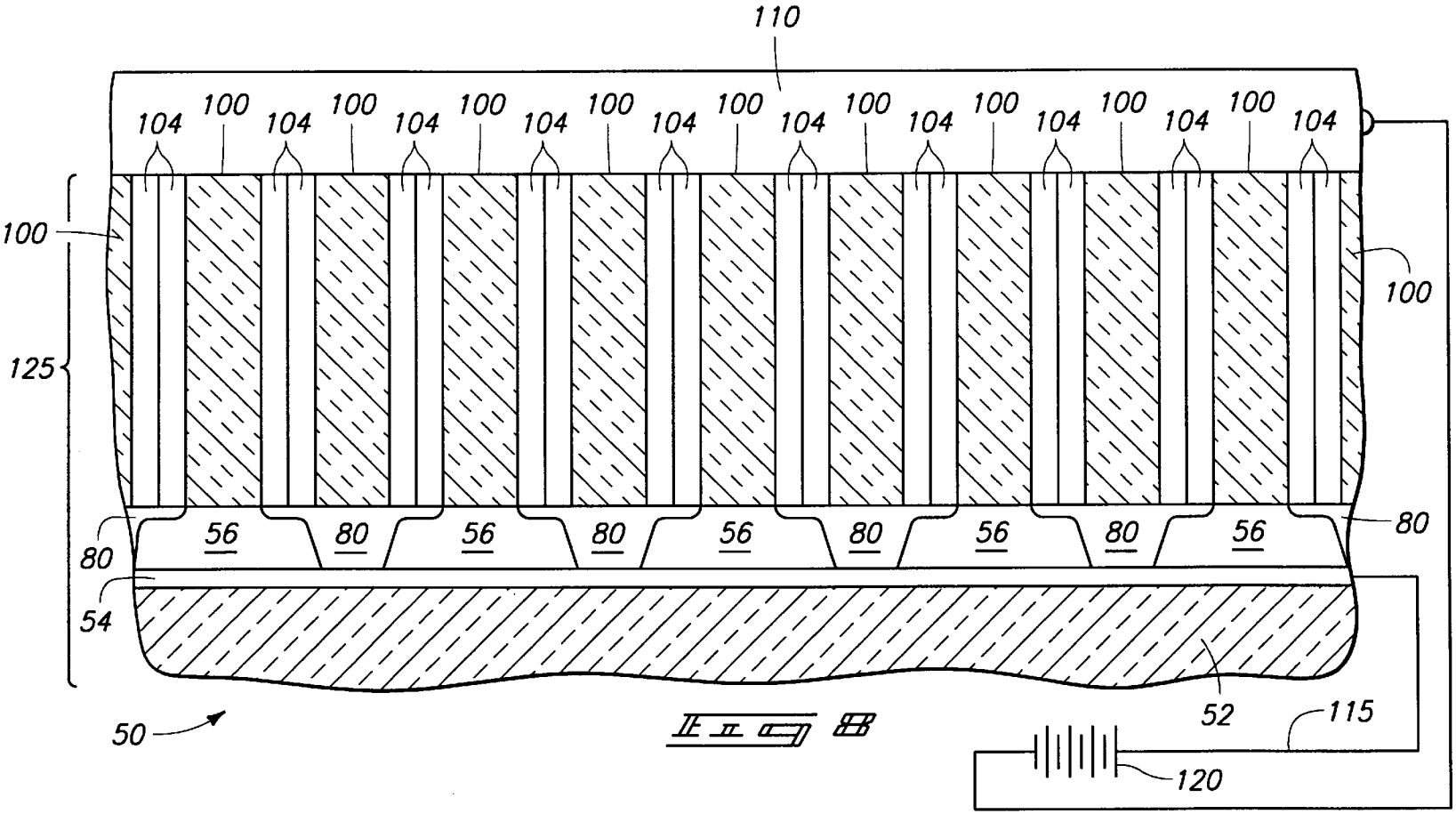
FIG. 8 is a view of the FIG. 3 substrate at a processing step subsequent to that o f FIG. 7.
Figure 11:
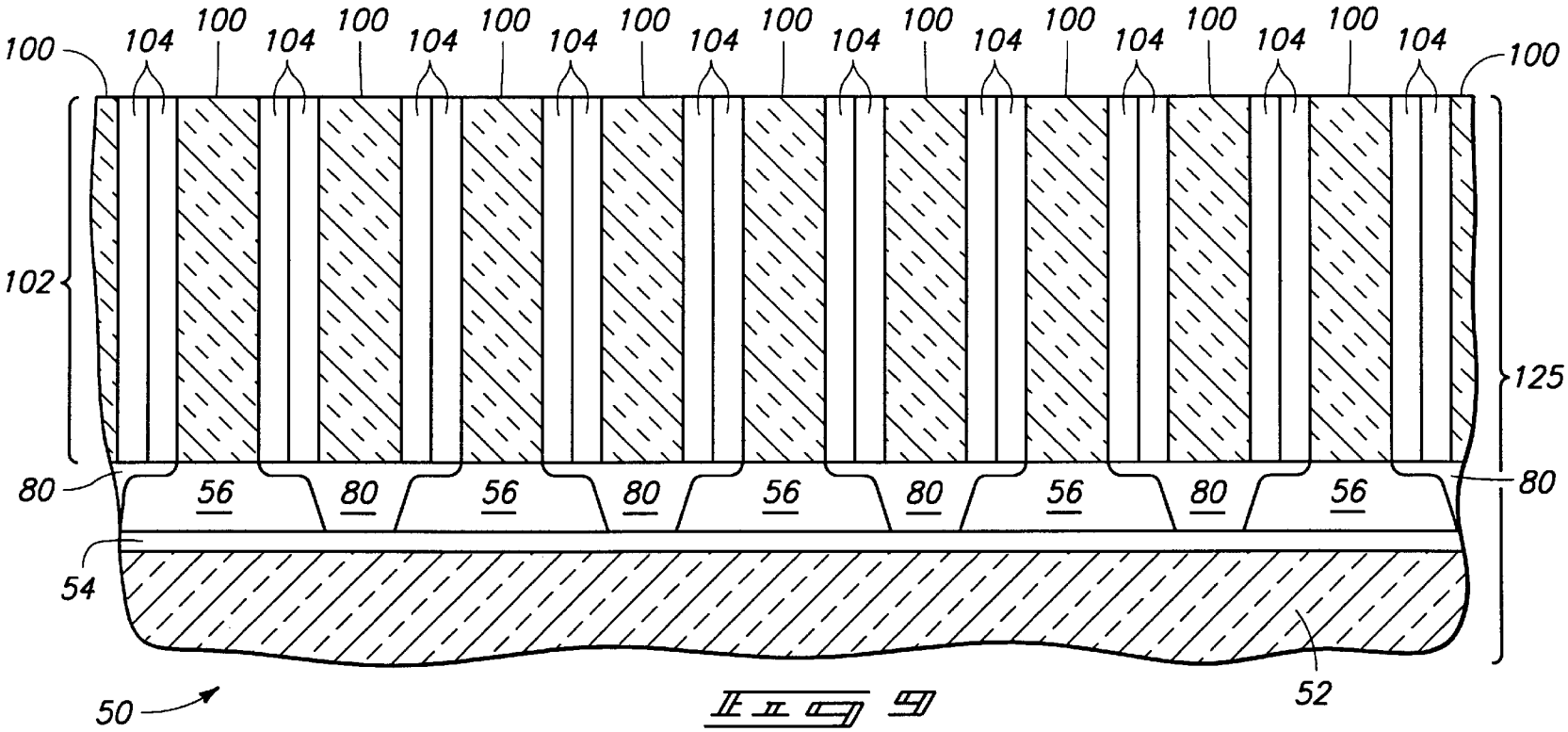
Figure 11:
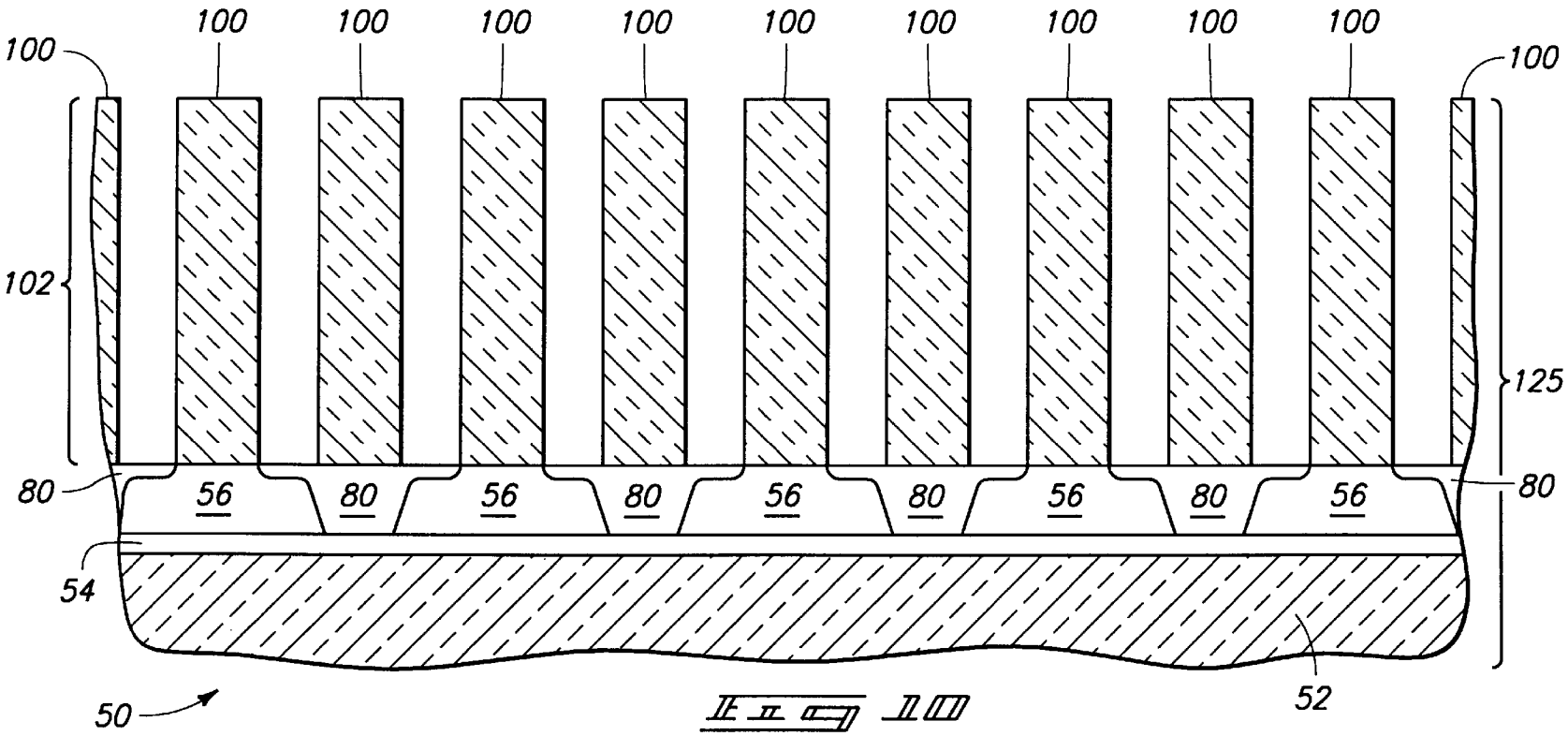
Figure 11:
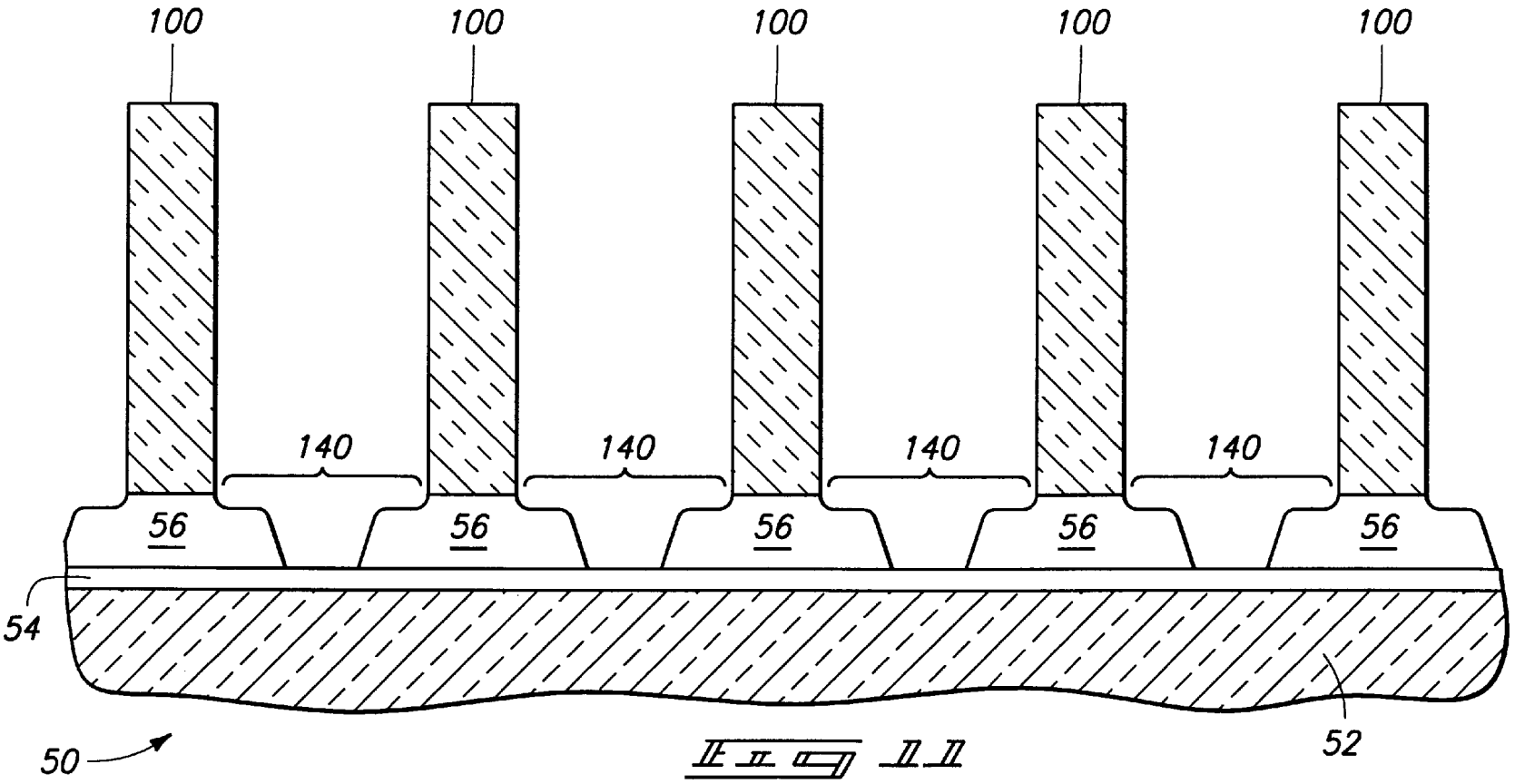
Figure 11:
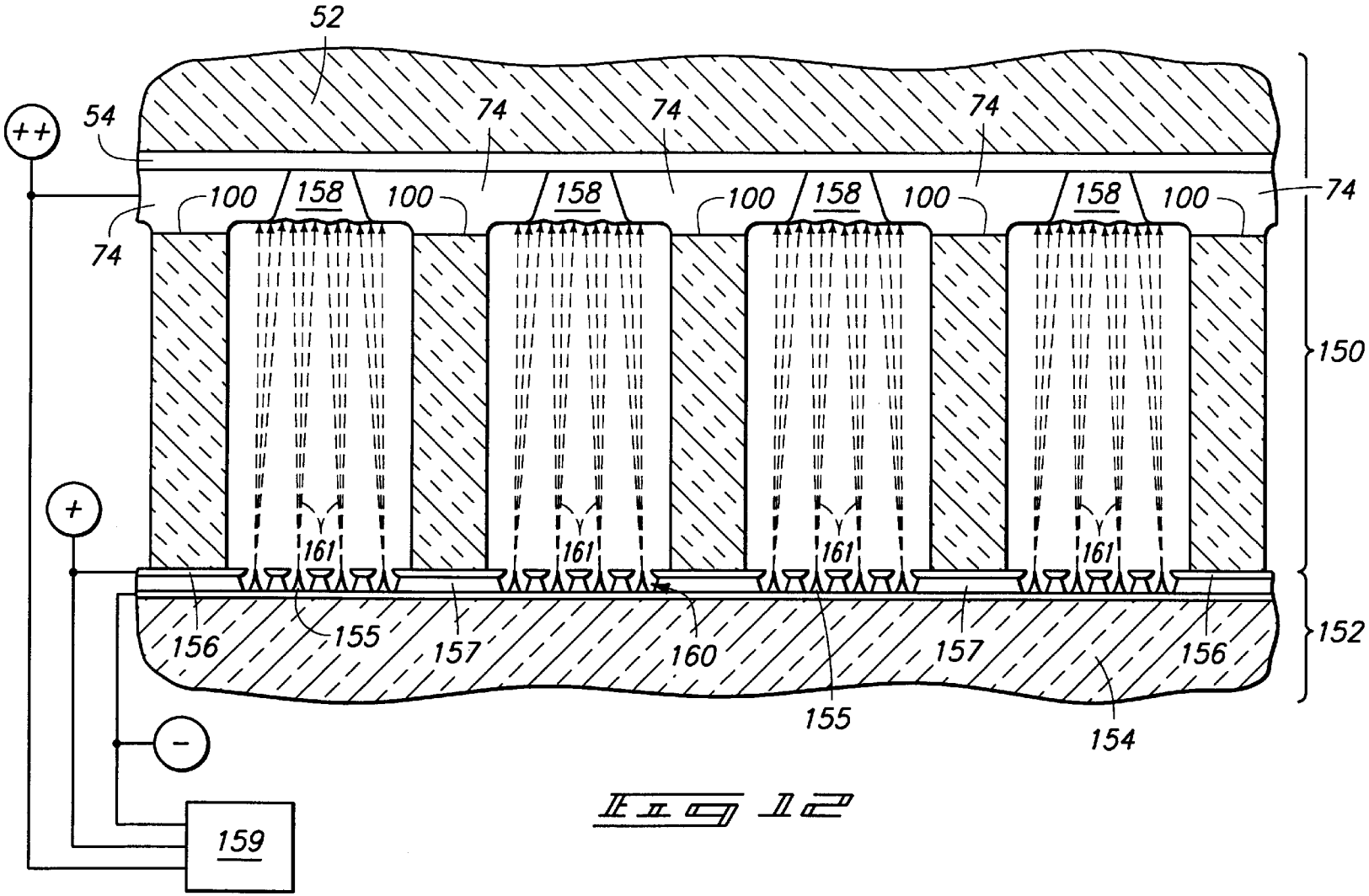
Figure 11E:
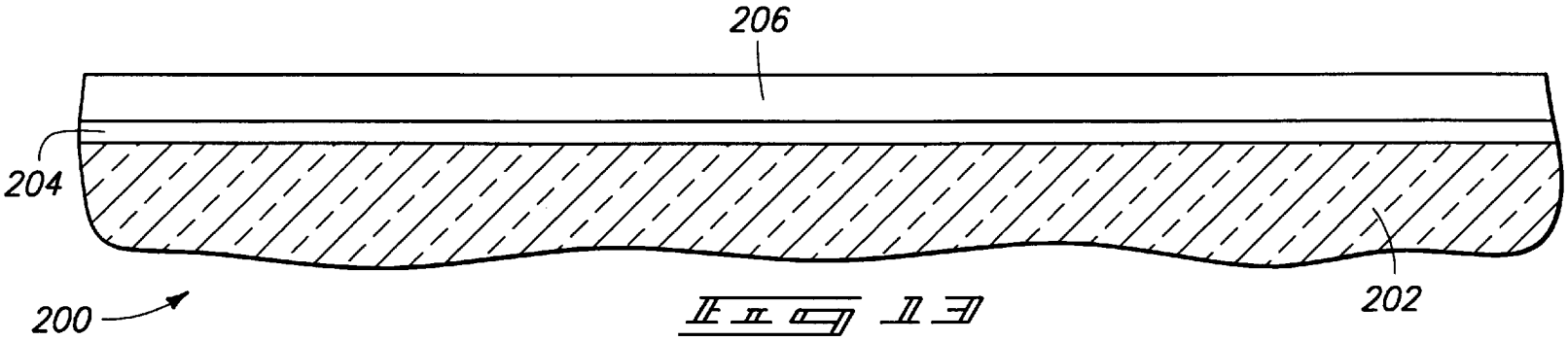
Figure 11F:
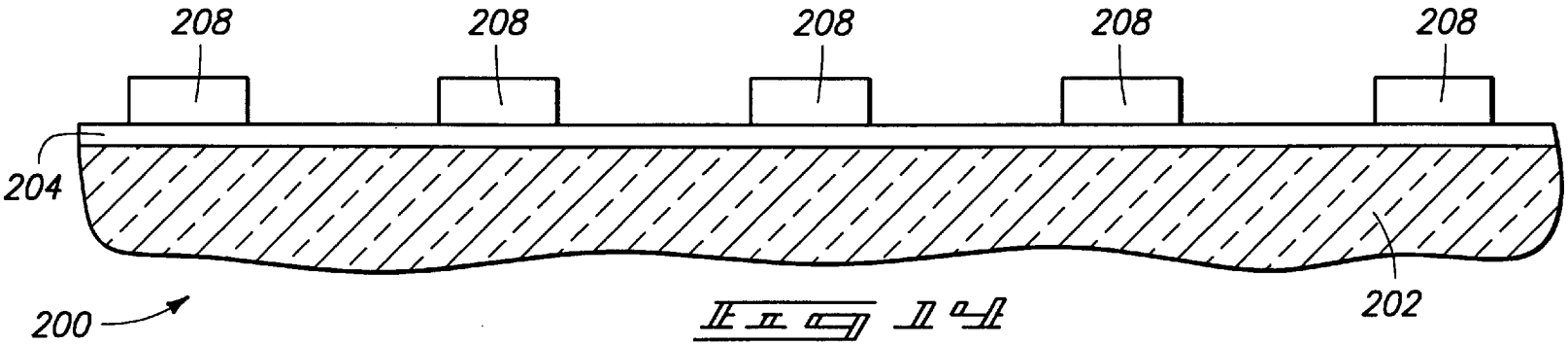

Referring to FIG. 8, an electrical contact 115 is provided between foil electrode 110 and conductive material layer 54. The electrical contact can be established to conductive material 54 through, for example, a metal spring clip. A power source 120 is provided along the electrical contact 115 and utilized to generate electrical current between conductive layer 54 and conductive foil 110. Conductive layer 54 functions as an anode during the generation of electrical current, and conductive foil 110 functions as a cathode. An exemplary voltage applied by source 120 is within a range of from about 500 to about 1,000 volts.

In preferred embodiments, face plate/spacer slice assembly 125 is heated to a temperature of from about 280° C. to about 500° C. as the voltage is applied between conductive layer 54 and conductive foil 110. Under the above-described conditions of heating and application of voltage, lithium and/or sodium atoms can be liberated from the glass of spacers 100. Such liberated lithium and/or sodium ions are positively-charged and attracted to the negatively-charged electrode 110. As the lithium and/or sodium atoms migrate toward electrode 110, a negative fixed charge remains in the bulk of spacer glass 100, leaving behind ionized non-bonding oxygen atoms within both spacer glass 100 and filler glass 104. The ionized oxygen atoms can be strongly attracted to the positively charged materials comprising discrete elements 74 and intervening sacrificial material 80. Portions of spacers 100 in contact with oxidizable material 56 can have oxygen ions which chemically react with atoms in the oxidizable material to form a silicon dioxide fusion layer, which fuses spacers 100 to discrete elements 74. Similar processes can also fuse spacers 100 to patches of sacrificial material 80, as well as fusing filler material 104 to discrete elements 74 and sacrificial patches 80. The above-described fusion processes can be generally referred to as anodic bonding processes.

An effectiveness of the anodic bonding process can be dependent on a flatness of planarized upper surfaces 78 and 81 (FIG. 6) as well as upon a flatness of a bottom surface of slice 102. Anodic bonding becomes more effective as more surface area of a spacer material is in contact with surface area of an underlying material to which the spacer is to be anodically bonded. In addition to utilizing flat surfaces for maintaining a high degree of contact, it is also preferred that the surfaces be free of extraneous particles which would interfere with contact between the surfaces. It is found that the above-described anodic bonding process is typically self-limiting, and takes roughly 10 to 15 minutes to achieve completion, depending on the strength of an applied field, the alkaline metal (for example, sodium, lithium and potassium) content of the glass spacers 100, and a temperature to which assembly 125 is exposed during the bonding process.

FIG. 9 illustrates the anodically bonded substrate/spacer slice assembly 125 after removal of electrical contact 115 and electrode 110. Slice 102 retains a planar surface after the anodic bonding, due to the previous planarization of layers 80 and 56 (FIG. 6). In the event that some non-planarity is introduced into an upper surface of slice 102 during the anodic bonding process, upper surface 102 can be planarized by, for example, chemical-mechanical polishing. It is desired that the upper surface of slice 102 be planar prior to proceeding with subsequent process steps, as it is desired that all of the spacers 100 utilized for bonding face plate 52 to a base plate have identical lengths as one another.

Referring to FIG. 10, the filler glass 104 (FIG. 9) and any unbonded spacer glass 100 is etched away in a 20° C. to 40° C. acid bath comprising from about 2% to about 10% hydrogen chloride in deionized water. The duration of the etch is typically from about 0.5 to about 4 hours, with the duration varying in part on an amount of agitation and a thickness of filler glass 104 that is etched away. After the above-described etching, only the spacers 100 remain anodically bonded atop substrate 52.

Figure 11:
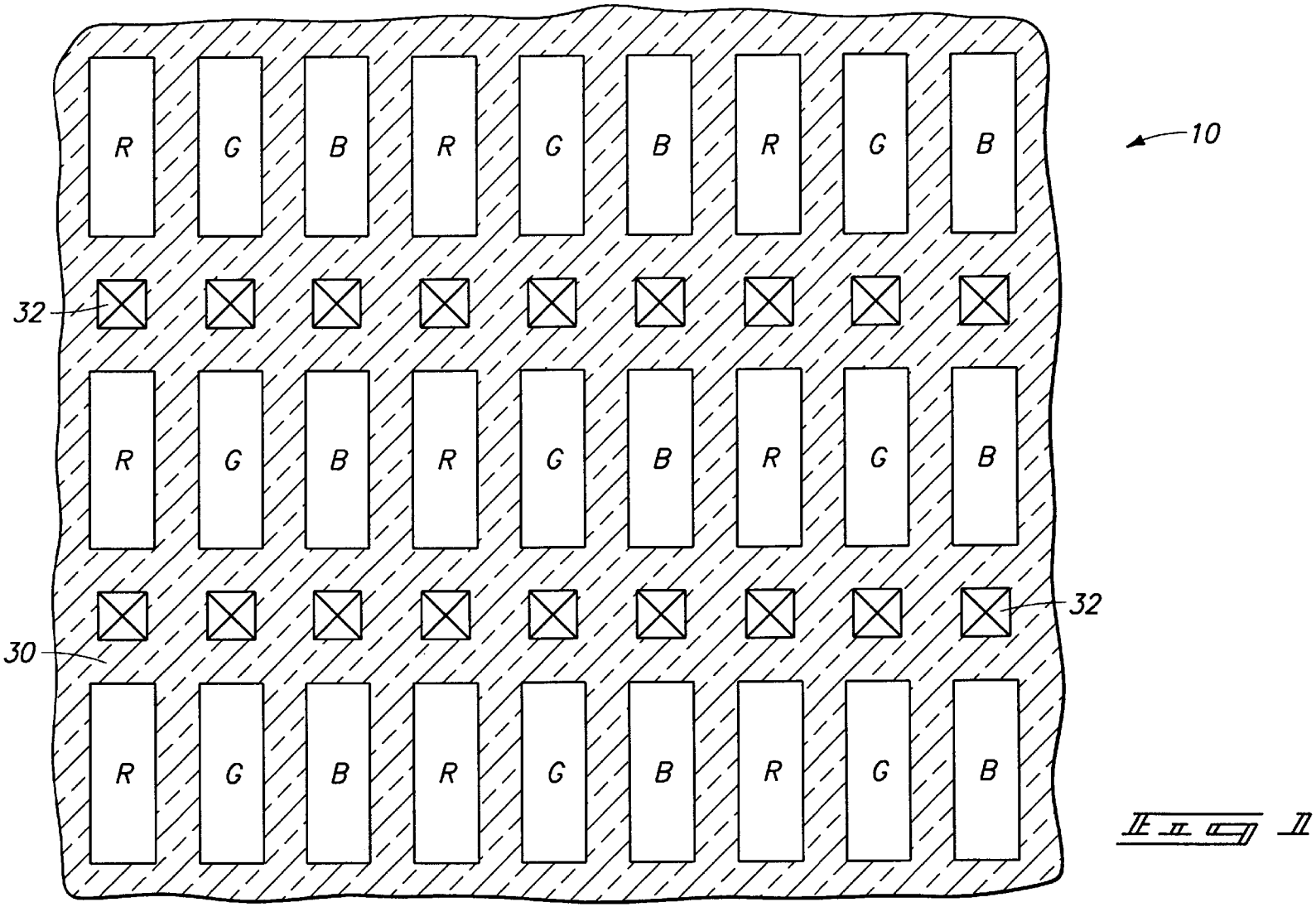
FIG. 11 is a view of the FIG. 3 substrate at a processing step subsequent to that of FIG. 10.

Referring to FIG. 11, sacrificial layer 80 is removed. An exemplary method for removing an aluminum-comprising sacrificial layer 80 is a wet aluminum etch. Removal of sacrificial layer 80 also removes any of spacer columns 10 bonded to sacrificial material layer 80, thus leaving only the spacers 100 bonded to upper surfaces 78 of mesas 64 (FIG. 5). As discussed above, such upper surfaces are provided in spacer bonding locations (such as the bonding locations 32 illustrated in FIG. 2). The locations where layer 80 (FIG. 10) is removed correspond to phosphor deposition locations 140.

FIG. 12 shows a cross-sectional view through a portion of a field emission evacuated flat panel display incorporating a face plate assembly of the present invention. The display includes a face plate assembly 150 and a base plate assembly 152. Base plate assembly 152 can be formed by depositing a conductive layer, such as conductively doped silicon, on top of a glass substrate 154 and etching the conductive layer to form individually conically-shaped microcathodes 155 (only some of which are labeled). Each of microcathodes 155 functions as an emitter. Microcathodes 155 are located within radially symmetrical apertures 160 (only some of which are labeled) formed through a conductive gate layer 156 and a lower insulating layer 157.

Face plate assembly 150 comprises silicate glass substrate 52, conductive layer 54, discrete elements 74 and glass spacers 100. Each of spacers 100 bears against an expanse of gate layer 156. Phosphor dots 158 are provided between discrete elements 74. Phosphor dots 158 can be provided by, for example, deposition (such as, for example, electrophoresis) or printing (such as, for example, screen printing or ink jet printing) on conductive layer 54.

A voltage source 159 is provided to apply a voltage differential between microcathodes 155 and surrounding gate apertures 160. Application of such voltage differential causes a stream of electrons 161 to be emitted toward the phosphor dots on face plate assembly 150. The screen, which is charged via conductive layer 54 to a potential that is higher than that applied to gate layer 156, functions as an anode toward which the emitted electrons accelerate. Once the emitted electrons contact the phosphor dots, light is emitted. The emitters 155 are typically matrix addressable via circuitry (not shown), and thus can be selectively activated to display a desired image on the phosphor-coated screen of face plate 150.

In other embodiments (not shown), an antireflective layer can be provided between substrate 52 and discrete elements 74. Such antireflective layer can comprise, for example, silicon nitride, and preferably has an optical thickness of about one-quarter of the wavelength of light in the middle of the visible spectrum (about 650 Å in the case of silicon nitride). Such antireflective layer can reduce reflectivity of subsequently deposited opaque layers. In embodiments in which an antireflective layer is provided, such is preferably provided beneath conductive layer 54, and preferably extends under phosphor regions 158, as well as under oxidizable material 56.

In the above-described embodiment, discrete elements 74 function as black matrix materials.

A second embodiment method of the present invention is described with reference to FIGS. 13–16. FIGS. 13–16, like the above-discussed FIGS. 3–11, illustrate a cross-sectional sideview along the line C—C of FIG. 2, and the scale of FIGS. 13–16 is comparable to that of FIGS. 3–11.

Referring to FIG. 13, a face plate structure 200 is illustrated at a preliminary processing step. Face plate structure 200 comprises a substrate 202, a transparent conductive layer 204 formed over substrate 202, and an insulative layer 206 formed over conductive layer 204. Substrate 202 can comprise, for example, silicate glass such as the glass of substrate 52 described above with reference to the embodiment of FIGS. 3–11. Conductive layer 204 can comprise, for example, indium tin oxide or tin oxide, and insulative layer 206 can comprise, for example, silicon dioxide or borophosphosilicate glass. An antireflective coating (not shown) can be formed beneath conductive layer 204.

Referring to FIG. 14, insulative layer 206 is formed into insulative material blocks 208. Insulative blocks 208 can be formed, by, for example, subjecting layer 206 to photolithographic processing coupled with an oxide etch.

Figure 15:
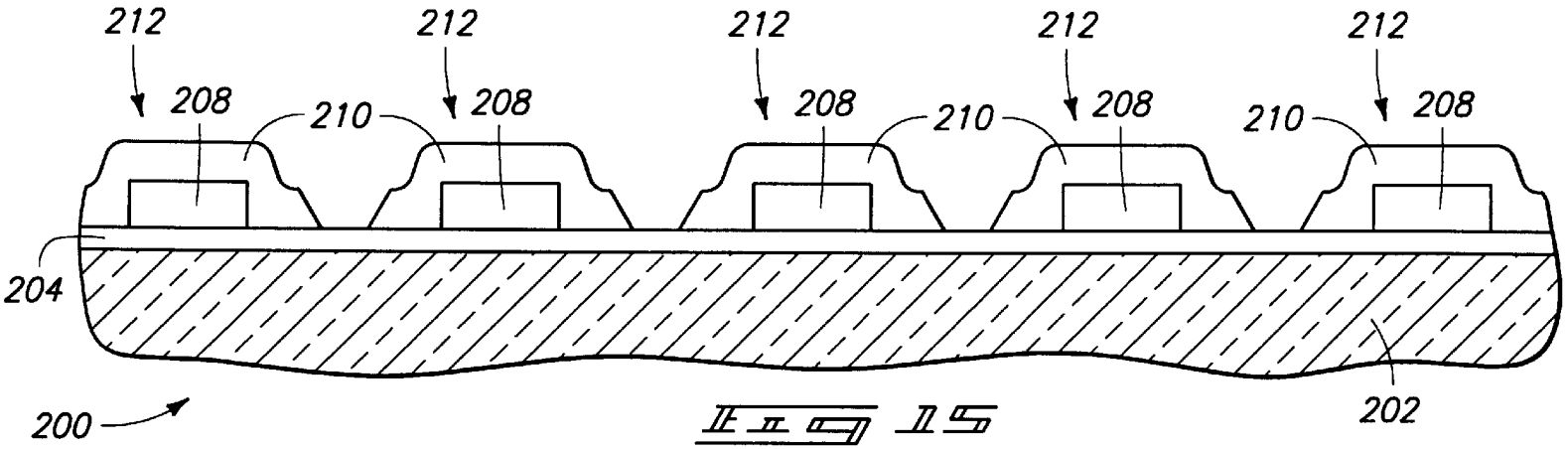
FIG. 15 is a view of the FIG. 13 substrate at a processing step subsequent to that of FIG. 14.

Referring to FIG. 15, an oxidizable material 210 is provided over blocks 208 and formed into separate discrete elements 212. Oxidizable material 210 can comprise, for example, the materials discussed above regarding oxidizable material 56. An exemplary material is silicon. Oxidizable material 210 can be formed into the shown separate discrete elements by photolithographic processing.

Figure 16:
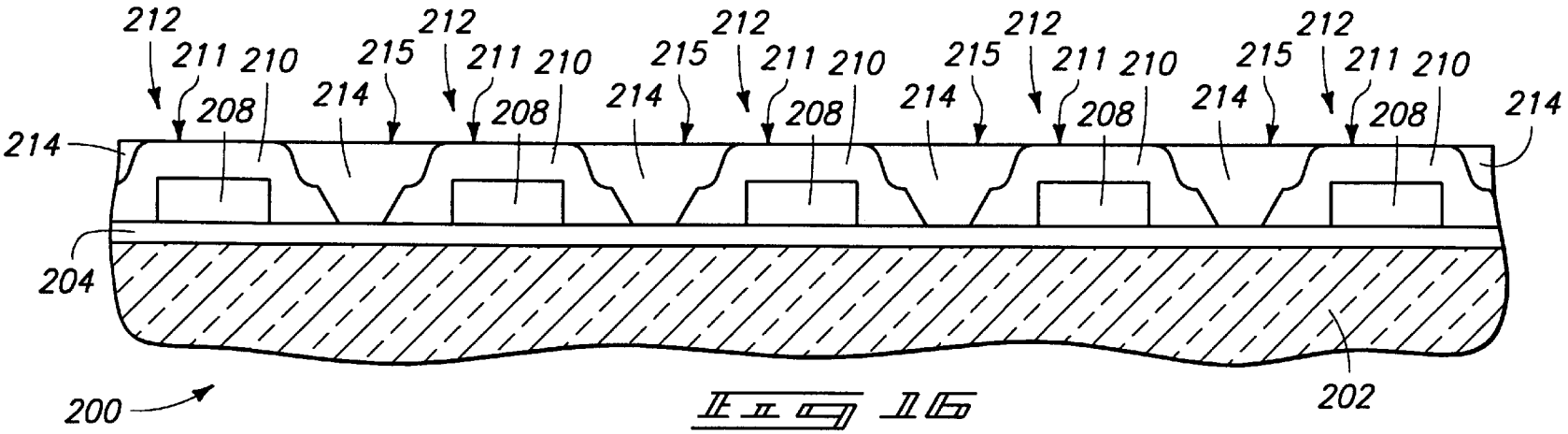
FIG. 16 is a view of the FIG. 13 substrate at a processing step subsequent to that of FIG. 15.

Referring to FIG. 16, a sacrificial material 214 is provided over and between discrete elements 212, and subsequently subjected to planarization. The planarization forms a planarized upper surface comprising upper surfaces 215 of sacrificial material 214 and upper surfaces 211 of discrete elements 212.

After the processing of FIGS. 13–16, wafer fragment 200 can be subjected to subsequent processing analogous to that described above with reference to FIGS. 7–11. Such subsequent processing can form spacers anodically bonded to upper surfaces 211, and can incorporate face plate 200 into an emitter display device analogous to the display device of FIG. 12.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. A method of fabricating a flat panel evacuated display, comprising:

forming an oxidizable material layer over a face plate substrate, the oxidizable material having an upper surface, the oxidizable material being provided in a plurality of separate discrete elements;

forming a layer of sacrificial material over the oxidizable material upper surface and over intervening regions of the face plate substrate between the separate discrete elements, the sacrificial material being selectively removable relative to the oxidizable material;

removing sacrificial material from over the oxidizable material upper surface and leaving sacrificial material between the discrete elements; after the removing, the sacrificial material between the discrete elements having a substantially planarized upper surface;

bonding a plurality of load-bearing spacers to the oxidizable material upper surface; and after the bonding, removing the sacrificial material from between the separate discrete elements.

2. The method of claim 1 further comprising forming an anti-reflective layer over the substrate between the discrete elements.

3. The method of claim 1 further comprising, prior to forming the oxidizable material layer, coating the substrate with an anti-reflective layer.

4. The method of claim 1 wherein the oxidizable material comprises silicon.

5. The method of claim 1 wherein the spacers comprise glass and the bonding comprises anodic bonding.

6. The method of claim 1 wherein the substrate is a silicate glass face plate.

7. The method of claim 1 wherein the sacrificial layer comprises at least one of cobalt oxide, aluminum, chromium, cobalt or molybdenum.

8. The method of claim 1 wherein the bonding the spacers further comprises providing spacers over the sacrificial layer, the spacers over the sacrificial layer being removed when the sacrificial layer is removed.

9. The method of claim 1 wherein:

the spacers comprise glass;

the bonding comprises anodic bonding of the glass spacers to both the oxidizable material and the sacrificial layer; and the spacers over the sacrificial layer are removed when the sacrificial layer is removed.

10. The method of claim 9 wherein the anodically bonded spacers are separated from one another by a filler glass, and further comprising etching away the filler glass.

11. The method of claim 1 wherein the substrate and bonded spacers together comprise a face plate/spacer assembly, and further comprising:

providing a base plate separated from the face plate by the spacers; and reducing a pressure between the face plate and base plate to form the evacuated display.

12. The method of claim 11 further comprising providing a phosphor associated with the face plate and emitters associated with the base plate.

13. A method of fabricating a flat panel evacuated display, comprising:

forming a transparent conductive layer over a substrate;

forming oxidizable material over the transparent conductive layer, the oxidizable material being provided in a plurality of separate discrete elements, each element comprising a lower region and an upper region, the lower region comprising a lateral periphery and the upper region not extending to the lower region lateral periphery;

forming a layer of sacrificial material over the oxidizable material and over intervening regions of the substrate between the separate discrete elements, the sacrificial material being selectively removable relative to the oxidizable material;

planarizing the layer of sacrificial material to remove the sacrificial material from over the upper regions of the oxidizable material; after the planarizing, the upper regions having upper surfaces that define upper surfaces of the oxidizable material;

providing a plurality of spacers, each spacer having a bondable surface;

positioning at least some of the bondable surfaces on the upper surfaces of the oxidizable material;

anodically bonding the bondable surfaces to the oxidizable material; and removing the sacrificial material from between the separate discrete elements.

14. The method of claim 13 wherein the oxidizable material comprises silicon.

15. The method of claim 13 wherein the transparent conductive layer comprises indium tin oxide or tin oxide.

16. The method of claim 13 wherein the substrate is a silicate glass face plate.

17. The method of claim 13 wherein the sacrificial layer comprises at least one of cobalt oxide, aluminum, chromium, cobalt or molybdenum.

18. The method of claim 13 wherein the forming the oxidizable material comprises:

depositing a layer of the oxidizable material over the transparent conductive layer;

forming a first mask over the layer of the oxidizable material to mask regions of the oxidizable material while leaving other regions unmasked;

etching only partially into the unmasked regions until the masked regions are mesas extending above the unmasked regions;

after the etching only partially, providing a second mask which extends over the mesas and over the oxidizable material proximate the mesas, the second mask leaving regions of the oxidizable material between the mesas exposed; and etching the exposed regions to remove the oxidizable material within said exposed regions and separate the oxidizable material into the plurality of separate discrete elements, the mesas being the upper regions of the elements.

19. The method of claim 18 wherein the first and second masks comprise photoresist, and further comprising removing the first and second masks before forming the layer of sacrificial material.

20. The method of claim 18 wherein the oxidizable material comprises silicon.

21. The method of claim 13 further comprising providing a plurality of discrete insulative material blocks over the transparent conductive layer, and wherein the forming the oxidizable material comprises:

depositing a layer of the oxidizable material over the transparent conductive layer and the discrete insulative material blocks, regions of the layer of the oxidizable material over the blocks comprising mesas which extend above other regions of the oxidizable material layer that are not over the blocks;

providing a mask which extends over the mesas and over the oxidizable material proximate the mesas, the mask leaving regions of the oxidizable material between the mesas exposed; and etching the exposed regions to remove the oxidizable material within said exposed regions and separate the oxidizable material into the plurality of separate discrete elements, the mesas being the upper regions of the elements.

22. The method of claim 21 wherein the insulative material comprises silicon dioxide.

23. The method of claim 21 wherein the mask comprises photoresist, and further comprising removing the mask before forming the layer of sacrificial material.

24. The method of claim 21 wherein the oxidizable material comprises silicon.

25. The method of claim 13 further comprising, after removing the sacrificial material from between the discrete elements, providing a phosphor between the discrete elements.

26. The method of claim 13 wherein the substrate comprises a face plate for flat panel evacuated display, and the substrate and bonded spacers together comprise a face plate/spacer assembly, and further comprising:

providing a base plate separated from the face plate by the spacers; and reducing a pressure between the face plate and base plate to form the evacuated display.

27. The method of claim 26 further comprising providing a phosphor associated with the face plate and emitters associated with the base plate.

28. A method of fabricating a flat panel evacuated display, comprising:

forming a transparent conductive layer over a substrate;

forming a layer of silicon over the transparent conductive layer;

forming a first mask over the layer of silicon to mask regions of the silicon while leaving other regions unmasked;

removing a portion of the unmasked regions to shape the silicon, the shaped silicon having the masked regions as mesas extending above the unmasked regions, the mesas having uppermost surfaces;

providing a second mask which extends over the mesas and over silicon proximate the mesas, the second mask leaving segments of the silicon between the mesas exposed;

removing the exposed segments to separate the silicon into a plurality of separate discrete elements;

forming a layer of sacrificial material over the silicon discrete elements and over intervening regions of the substrate between the separate discrete silicon elements, the sacrificial material being selectively removable relative to the silicon;

planarizing the layer of sacrificial material to remove the sacrificial material from over the silicon upper surface;

bonding a plurality of spacers to the mesa uppermost surfaces; and removing the sacrificial material from between the separate discrete elements.

29. The method of claim 28 further comprising, prior to forming the layer of silicon, coating the substrate with an anti-reflective layer.

30. The method of claim 28 wherein the spacers comprise glass and the bonding comprises anodic bonding.

31. The method of claim 28 wherein the substrate is a silicate glass face plate.

32. The method of claim 28 wherein the sacrificial layer comprises at least one of cobalt oxide, aluminum, chromium, cobalt or molybdenum.

33. The method of claim 28 wherein the bonding the spacers further comprises bonding spacers to the sacrificial layer, the spacers bonded to the sacrificial layer being removed when the sacrificial layer is removed.

34. The method of claim 28 wherein:

the spacers comprise glass;

the bonding comprises anodic bonding of the glass spacers to both the oxidizable material and the sacrificial layer; and the spacers bonded to the sacrificial layer are removed when the sacrificial layer is removed.

35. The method of claim 34 wherein the anodically bonded spacers are separated from one another by a filler glass, and further comprising etching away the filler glass.

36. The method of claim 28 wherein the substrate comprises a face plate for flat panel evacuated display, and the substrate and bonded spacers together comprise a face plate/spacer assembly, and further comprising:

providing a base plate separated from the face plate by the spacers; and reducing a pressure between the face plate and base plate to form the evacuated display.

37. The method of claim 36 further comprising providing a phosphor associated with the face plate and emitters associated with the base plate.

38. A method of fabricating a flat panel evacuated display, comprising:

providing a substrate having an upper surface;

forming a transparent conductive layer over the substrate upper surface;

providing a plurality of discrete insulative material blocks over the transparent conductive layer;

depositing a layer of silicon over the transparent conductive layer and the discrete insulative material blocks, first regions of the layer of silicon being over the blocks and second regions of the layer of silicon not being over the blocks, the first regions extending to above the second regions;

providing a mask which extends over the first regions and over portions of the second regions proximate the first regions, the mask leaving segments of the second regions exposed; and removing the exposed segments to separate the silicon into a plurality of separate discrete elements;

forming a layer of sacrificial material over the silicon discrete elements and over intervening regions of the substrate between the separate discrete silicon elements, the sacrificial material being selectively removable relative to the silicon;

planarizing the layer of sacrificial material to remove the sacrificial material from over the silicon upper surface, the first regions having uppermost surfaces after the planarizing;

bonding a plurality of spacers to the uppermost surfaces; and removing the sacrificial material from between the separate discrete elements.

39. The method of claim 38 wherein the providing the insulative material blocks comprises:

forming a layer of the insulative material over the substrate; and removing portions of the layer of insulative material to form the discrete blocks.

40. The method of claim 38 wherein the providing the insulative material blocks comprises:

forming a layer of the insulative material over the substrate;

forming a photoresist over the insulative material, the photoresist covering portions of the insulative material and leaving other portions uncovered; and removing uncovered portions of the layer of insulative material to form the discrete blocks.

41. The method of claim 38 wherein the insulative material comprises silicon dioxide or BPSG.

42. The method of claim 38 further comprising, prior to providing the insulative material blocks, coating the substrate with an anti-reflective layer.

43. The method of claim 38 wherein the spacers comprise glass and the bonding comprises anodic bonding.

44. The method of claim 38 wherein the substrate is a silicate glass face plate.

45. The method of claim 38 wherein the sacrificial layer comprises at least one of cobalt oxide, aluminum, chromium, cobalt or molybdenum.

46. The method of claim 38 wherein the bonding the spacers further comprises bonding spacers to the sacrificial layer, the spacers bonded to the sacrificial layer being removed when the sacrificial layer is removed.

47. The method of claim 38 wherein:

the spacers comprise glass;

the bonding comprises anodic bonding of the glass spacers to both the oxidizable material and the sacrificial layer; and the spacers bonded to the sacrificial layer are removed when the sacrificial layer is removed.

48. The method of claim 47 wherein the anodically bonded spacers are separated from one another by a filler glass, and further comprising etching away the filler glass.

49. The method of claim 38 wherein the substrate comprises a face plate for flat panel evacuated display, and the substrate and bonded spacers together comprise a face plate/spacer assembly, and further comprising:

providing a base plate separated from the face plate by the spacers; and reducing a pressure between the face plate and base plate to form the evacuated display.

50. The method of claim 49 further comprising providing a phosphor associated with the face plate and emitters associated with the base plate.

* * * * *

UNITED STATES PATENT AND TRADEMARK OFFICE

CERTIFICATE OF CORRECTION

PATENT NO : 6,004,179

DATED : December 21, 1999

INVENTOR(S) : James J. Alwan

It is certified that error appears in the above-identified patent and that said Letters Patent is hereby corrected as shown below:

Col. 1, line 56
replace "screen en,"
with --screen, --.

Col. 8, line 56
replace "73"
with --78--.

Signed and Sealed this

Sixth Day of February, 2001

*Attest:*

Q. TODD DICKINSON

*Attesting Officer*

*Director of Patents and Trademarks*